US009073660B2

(12) United States Patent
Deyerl et al.

(10) Patent No.: US 9,073,660 B2
(45) Date of Patent: Jul. 7, 2015

(54) PLASTICS MATERIAL CONTAINER WITH STRAIGHT APERTURE AREAS

(71) Applicant: KRONES AG, Neutraubling (DE)

(72) Inventors: Heinrich Deyerl, Teunz (DE); Gerhard Schuster, Pfakofen (DE); Bastian Tiβmer, Regensburg (DE)

(73) Assignee: KRONES AG (DE)

( * ) Notice: Subject to any disclaimer, the term of this patent is extended or adjusted under 35 U.S.C. 154(b) by 0 days.

(21) Appl. No.: 13/931,304

(22) Filed: Jun. 28, 2013

(65) Prior Publication Data

US 2014/0001190 A1 Jan. 2, 2014

(30) Foreign Application Priority Data

Jun. 29, 2012 (DE) ..... 10 2012 105 778

(51) Int. Cl.

| | |
|---|---|
| ***B65D 1/02*** | (2006.01) |
| ***B65B 3/02*** | (2006.01) |
| ***B67C 3/02*** | (2006.01) |
| *B67C 3/26* | (2006.01) |

(52) U.S. Cl.

CPC ..... *B65D 1/0223* (2013.01); *B65B 3/022* (2013.01); *B65D 1/0276* (2013.01); *B65D 1/023* (2013.01); *B67C 3/02* (2013.01); *B67C 2003/2671* (2013.01); *B65D 2501/0018* (2013.01); *B65D 2501/0072* (2013.01)

(58) Field of Classification Search

CPC ..... B65D 1/0276
USPC ..... 220/575, 608; 215/381, 382, 383, 384
See application file for complete search history.

(56) References Cited

U.S. PATENT DOCUMENTS

| | | | | |
|---|---|---|---|---|
| 3,727,783 | A | 4/1973 | Carmichael | 315/1 C |
| D237,586 | S | 11/1975 | Plummer | D9/503 |
| 5,178,289 | A * | 1/1993 | Krishnakumar et al. | 215/382 |
| D355,601 | S | 2/1995 | Buettner et al. | D9/503 |

(Continued)

FOREIGN PATENT DOCUMENTS

| | | | |
|---|---|---|---|
| CN | 2841544 | 11/2006 | B65D 1/02 |
| DE | 17 22 082 | 5/1956 | |

(Continued)

OTHER PUBLICATIONS

Notice of Allowance issued in related U.S. Appl. No. 29/434,884, dated Jan. 3, 2014 (23 pgs).

(Continued)

*Primary Examiner* — Steven A. Reynolds
*Assistant Examiner* — King M Chu
(74) *Attorney, Agent, or Firm* — Hayes Soloway P.C.

(57) ABSTRACT

A plastics material container has an aperture area, a shoulder area adjoining the aperture area in a longitudinal direction of the plastics material container, a main body adjoining this shoulder area in the longitudinal direction of the plastics material container and a base area adjoining the main body in the longitudinal direction of the plastics material container. The shoulder area is widened in the longitudinal direction of the plastics material container from the aperture area in the direction of the main body, and a transition area is provided between the aperture area and the shoulder area. The transition area has a portion widening in the longitudinal direction of the plastics material container from the aperture in the direction of the shoulder area and having a straight course.

22 Claims, 4 Drawing Sheets

(56) References Cited

U.S. PATENT DOCUMENTS

| | | | | |
|---|---|---|---|---|
| 5,598,941 | A * | 2/1997 | Semersky et al. | 215/384 |
| D379,763 | S | 6/1997 | Ewing | D9/520 |
| D395,826 | S | 7/1998 | Hygaard | D9/520 |
| 5,971,184 | A * | 10/1999 | Krishnakumar et al. | 215/384 |
| 6,044,996 | A * | 4/2000 | Carew et al. | 215/381 |
| D489,991 | S | 5/2004 | Duebel et al. | D9/538 |
| 6,964,347 | B2 * | 11/2005 | Miura | 215/384 |
| D542,142 | S | 5/2007 | Walton et al. | D9/539 |
| D546,687 | S | 7/2007 | Boukobza | D9/516 |
| D570,217 | S | 6/2008 | Meillerais | D9/520 |
| 7,416,088 | B2 | 8/2008 | Boukobza | 215/373 |
| D583,245 | S | 12/2008 | Lepoitevin | D9/538 |
| D595,581 | S | 7/2009 | Brunson | D9/520 |
| D600,559 | S | 9/2009 | Lepoitevin | D9/538 |
| D601,903 | S | 10/2009 | Lepoitevin | D9/538 |
| D606,410 | S | 12/2009 | Kissinger et al. | D9/516 |
| D607,733 | S | 1/2010 | Lepoitevin | D9/538 |
| D610,017 | S | 2/2010 | Howell et al. | D9/538 |
| 7,757,874 | B2 * | 7/2010 | Ross | 215/381 |
| D621,271 | S | 8/2010 | Soni | D9/516 |
| D624,821 | S | 10/2010 | Leonardis | D9/503 |
| D644,515 | S | 9/2011 | Tieleman et al. | D9/516 |
| D650,677 | S | 12/2011 | Wurster et al. | D9/516 |
| 8,308,006 | B2 * | 11/2012 | Nievierowski et al. | 215/381 |
| D682,114 | S | 5/2013 | Kraus et al. | D9/554 |
| 2004/0195199 | A1 * | 10/2004 | Maki et al. | 215/381 |
| 2007/0262046 | A1 | 11/2007 | Zoppas | 215/375 |
| 2010/0006533 | A1 * | 1/2010 | Nievierowski et al. | 215/381 |
| 2011/0309090 | A1 | 12/2011 | Derrien et al. | 220/600 |
| 2013/0213925 | A1 | 8/2013 | Forsthovel et al. | 215/370 |

FOREIGN PATENT DOCUMENTS

| | | | |
|---|---|---|---|
| DE | 2 160 085 | 6/1973 | B65D 1/02 |
| DE | 106330 | 2/1975 | B67C 3/06 |
| DE | 69825632 | 9/2005 | B65D 1/02 |
| DE | 60202450 | 2/2006 | B65D 1/02 |
| DE | 602004010814 | 12/2008 | B65D 1/02 |
| FR | 1594446 | 6/1970 | B65D 1/02 |
| FR | 2 753 435 | 3/1998 | B65D 1/02 |
| JP | 6-270929 | 9/1994 | B65D 1/02 |
| JP | 08072843 | 3/1996 | B65D 1/02 |
| WO | WO 2006/067590 | 6/2006 | B65D 1/02 |
| WO | WO 2008/017746 | 2/2008 | B65D 1/02 |

OTHER PUBLICATIONS

Notice of Allowance issued in related U.S. Appl. No. 29/435,269, dated Jan. 7, 2014 (24 pgs).

European Search Report issued in corresponding European Patent Application Serial No. 09 170 284.0, dated Nov. 9, 2011 (2 pgs).

Chinese Office Action issued in corresponding Chinese Patent Application Serial No. 2009101755436, dated Mar. 5, 2012 (9 pgs).

US Official Action issued in corresponding U.S. Appl. No. 12/560,301, dated Aug. 3, 2012 (23 pgs).

US Official Action issued in corresponding U.S. Appl. No. 12/560,301 dated Feb. 8, 2013 (14 pgs).

German Search Report issued in corresponding German Patent Application Serial No. 10 2012 105 778.8 dated Mar. 20, 2013 (5 pgs).

Office Action issued in related U.S. Appl. No. 12/560,301 dated May 21, 2013 (14 pgs).

Office Action issued in related U.S. Appl. No. 29/437,997, dated Feb. 6, 2014 (25 pgs).

Office Action issued in related U.S. Appl. No. 29/437,997, dated Mar. 24, 2014 (15 pgs).

Office Action issued in related U.S. Appl. No. 12/560,301, dated Nov. 22, 2013 (15 pgs).

Office Action issued in related U.S. Appl. No. 12/560,301, dated Sep. 11, 2014 (25 pgs).

Chinese Office Action issued in related application No. 201310272183.8, dated Jan. 19, 2015 (2 pgs).

European Office Action issued in related application No. 13 174 550.7, dated Sep. 3, 2014 (4 pgs).

* cited by examiner

Fig. 6
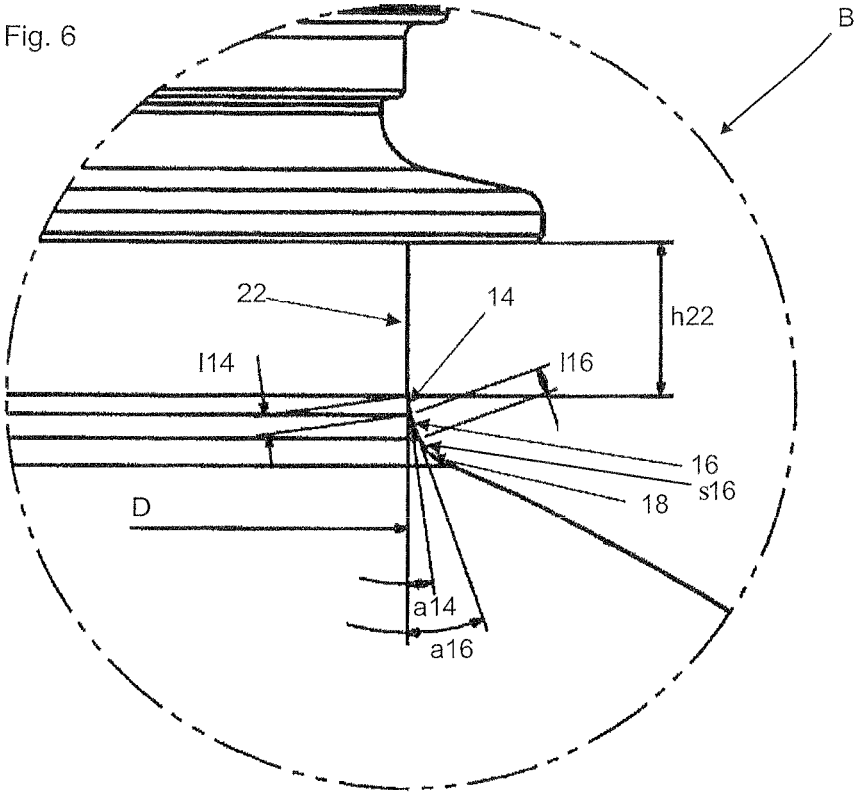
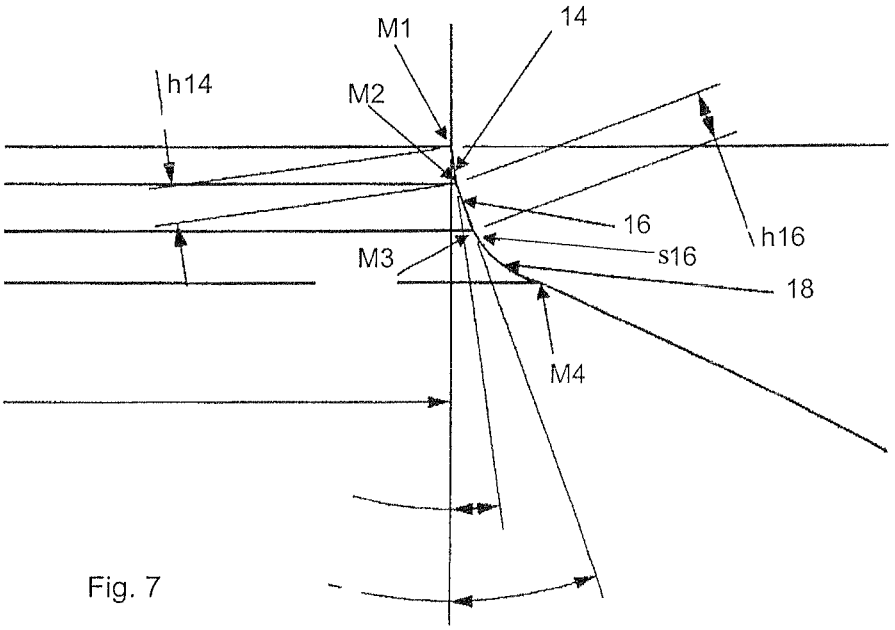
Fig. 7

PLASTICS MATERIAL CONTAINER WITH STRAIGHT APERTURE AREAS

BACKGROUND OF THE INVENTION

The present invention relates to a plastics material container. Numerous plastics material containers are known from the prior art. Plastics material containers of this type usually have a base area, a main body adjoining it, a shoulder area and an aperture area. In addition, different methods and apparatus for filling these containers are known from the prior art.

In the case of the containers known from the prior art, in particular PET containers or bottles, a cylindrical portion of a pre-set length is usually present below the mouthpiece or the aperture. This cylindrical portion is usually adjoined by an area which is curved towards the inside, i.e. towards the interior of the container, and which usually adjoins this cylindrical part tangentially in this case.

This area can in turn be followed by a further curved area or even a straight part. These areas can in turn merge into a plurality of radii or straight lines which have the maximum container diameter as a boundary. The diameter of the bottle neck too is variable. For many beverages or filled goods it would be desirable for them not to encounter the base of the container directly during the filling, but to flow off over the lateral wall or inner wall of the container. In this way, it is possible to prevent an excessive foaming of the product during the filling procedure. In this case the filled goods can be still beverages and/or beverages to be poured hot, in which case the effect of the foaming described above occurs, in particular, even in the case of carbonated filled goods and should be avoided.

The containers known from the prior art, however, have the drawback that, in particular in the aperture area of the container, the filled product does not pass over the wall but the flow is agitated by the internal configuration of the container and can tear away as a result.

The object of the present invention is therefore to provide a container which facilitates the filling thereof even with those products which are filled in over the inner wall of the container.

SUMMARY OF THE INVENTION

A plastics material container according to the invention has an aperture area and a shoulder area adjoining this aperture area in a longitudinal direction of the plastics material container. In addition, the container has a main body adjoining the shoulder area in the longitudinal direction of the plastics material container and, in addition, a base area adjoining the main body in the longitudinal direction of the plastics material container.

In addition, the shoulder area is widened in the longitudinal direction of the plastics material container from the aperture in the direction of the main body, and a transition area is provided between the aperture area and the shoulder area.

According to the invention this transition area has a portion widening in the longitudinal direction of the plastics material container from the aperture in the direction of the shoulder area and having a substantially straight course. In particular, the inner wall of the container in the aforesaid portion has a straight course or extends in a straight direction, and in particular in a straight direction which is situated in a common plane with the longitudinal direction of the container.

Adjoining in the longitudinal direction is understood as being that the respective area follows the other area, in which case this can be understood as being an indirect join but also a direct sequence of the areas adjoining one another in each case.

In this way, it is preferable for the widening portion to be a portion widening in a frustoconical manner. In this case this portion is thus advantageously situated at an angle to the aforesaid longitudinal direction of the container. The Applicants have discovered that the corrugation in the neck extension usually present in the case of containers from the prior art have an adverse effect upon the filling process. This area of the container has hitherto received little attention, since also on technical grounds it is situated in an area which is difficult to expand. The aforesaid corrugation, however, frequently prevents a liquid from running into the container in a smooth manner. In part it has the effect of a ski jump and the flow of the product to be poured is torn away as a result. It is precisely that the filling flow is not torn away as a result of the specified slope or the straight course into the aperture area of the container.

A further advantage of this procedure is an improved distribution of material of the plastics material. On account of this straight area instead of a radius of curvature facing towards the inside, more material can be removed from the aperture area of the container and thus material can be saved as a whole. If, for example, the aforesaid straight course is already pre-set on the wall of the mould it is possible for the thinned and properly tempered (plastics) material to be applied in a better manner to the wall of the mould and to slide literally around the edges and thus to be thinned in a smooth manner. In the prior art the material was fixed in this area and was thus not able to be distributed to other areas of the container.

In addition, the accumulation of material—present in the prior art—in the aperture area is unnecessary. It is therefore proposed at the same time that material should be saved in this area and/or should be moved to another location on the container, so that altogether less material can be consumed for the bottle or this material can be used to support the geometry at another location on the container.

A straight course or a substantially straight course is to be understood as meaning that a radius of curvature in this area is greater than 10 cm, preferably greater than 20 cm, and in a particularly preferred manner greater than 40 cm. It is preferable for no partial portions with radii of curvature below 10 cm to occur in the aforesaid substantially straight portion.

In the case of a further advantageous embodiment the container has a carrier ring. This carrier ring can be used even in the context of the production in order to convey the container. It is advantageous for the aforesaid transition area with the widening portion to be situated below the carrier ring in the longitudinal direction of the container, i.e. between the base area and the carrier ring. It would also be possible, however, for the container to be produced without a carrier ring. It would be additionally possible for the container to have—as well as or instead of a carrier ring—a locking ring which is used, in particular, for opening a safety lock.

In the case of a further advantageous embodiment the aforesaid areas of the plastics material container are formed in one piece with one another.

In the case of a further advantageous embodiment the container is a blow moulded container and, in particular, a stretch blow moulded container. This means that in order to produce this container a blow moulding process and, in particular a stretch blow moulding process, is used.

In the case of a further advantageous embodiment the shoulder area is widened with respect to the transition area. In this case this shoulder area can in turn be widened in a conical manner, but a curved widening—for example concave or convex—would also be possible here.

In the case of a further advantageous embodiment the container has an external thread. It is advantageous for the container also to have a locking ring which is used for tearing a closure seal when the container is opened.

In the case of a further advantageous embodiment the aperture area has a cylindrical portion which is adjoined by the transition area. It is advantageous in this case for this cylindrical portion to be situated at least in part and preferably completely below the carrier ring. In addition, it is preferable for the cylindrical portion to be of a length which is between 0.01 and 8 mm, preferably between 0.1 and 7 mm, and in a particularly preferred manner between 1 mm and 6 mm, and in a particularly preferred manner between 3 mm and 5 mm.

In the case of a further advantageous embodiment the widening portion extends, with respect to the longitudinal direction of the container, at an angle which is between 0.01° and 80°, preferably between 0.1° and 80°, preferably between 1° and 75°, and in a particularly preferred manner between 2° and 65°. In particular, the angles indicated are particularly well suited for achieving a uniform filling of the container above the inner wall thereof. By means of the sizes specified it is possible to prevent, in a particularly efficient manner, the filling flow from tearing off inside the container. Within the scope of experiments sample bottles with different geometries in the region of the geometry of the beginning of the neck were produced with a blow mould and were filled. The plastics material is, in particular, PET, but other plastics materials can also be used.

In the case of a further advantageous embodiment the aforesaid widening straight portion is of a length which is between 0.01 mm and 50 mm, preferably between 0.1 mm and 40 mm, in a particularly preferred manner between 1 mm and 20 mm, and in a particularly preferred manner between 3 mm and 20 mm.

In the case of a further advantageous embodiment the aforesaid straight portion directly adjoins the cylindrical portion. In this case it is possible for an edge to be formed between the straight portion and the cylindrical portion, but a (short) tangential transition would also be possible. In the case of a further advantageous embodiment the shoulder area widens starting from the transition area.

In the case of a further advantageous embodiment the widening portion with the straight course is adjoined by a further portion with a likewise straight course, these two straight portions preferably being at an angle with respect to each other.

It would also be possible, however, for the transition area with the straight course to be adjoined by a further curved course.

In the case of a further advantageous embodiment the plastics material container is made rotationally symmetrical in every case in the aperture area and the shoulder area as well as the transition area. In the case of a further advantageous embodiment the plastics material container has an internal volume which is between 0.1 l and 5 l, preferably between 0.25 l and 4 l.

In the case of a further advantageous embodiment the shoulder area and/or the main body of the plastics material container is constructed without edges in the peripheral direction, i.e. here in particular it has no edges which extend in a longitudinal direction of the plastics material container.

In the case of a further advantageous embodiment the transition area also has, in addition to the portion with the straight course, a portion with a curved course. In this way, it would be possible for the entire transition area to be formed from a plurality of portions, in particular with different curvatures, in which case at least one of these portions also has the straight course mentioned above.

In the case of a further advantageous embodiment the transition area has, in addition to the portion with the straight course, at least one further portion with a straight course. In this case these two portions can adjoin each other directly and, in particular, can be angled with respect to each other. It would also be possible, however, for a curved portion to be provided between these two portions extending straight. This curved area can have in this case a radius of curvature which is between 0.1 mm and 4.0 mm, preferably between 0.5 mm and 3.0 mm.

It is advantageous for the transition area to be formed from at least one straight member and (at least) one curved portion.

In addition, more than two portions extending straight could adjoin each other directly or indirectly.

The present invention further relates to a method of filling a plastics material container. In this case a plastics material container of the type described above is first made available. After that, the container is filled with a liquid. According to the invention the liquid poured into the plastics material container is applied at least in part to a portion—at a distance from the base area of the plastics material container—of the inner wall of the plastics material container. It is advantageous for the liquid to be applied to the inner wall area in the aperture area of the container.

In the case of a further advantageous method the liquid is applied to the inner wall of the container in a direction which also has a component in the peripheral direction of the container. In other words, the liquid applied in this area also has a swirl with respect to the longitudinal direction of the container.

It is advantageous for a swirl body, which also produces the component in the peripheral direction, to be used for filling the container.

In the case of a further advantageous method the container is produced by a blow moulding procedure, and in particular by a stretch blow moulding procedure.

In the case of a further preferred method the straight portion of the plastics material container is also stretched at least slightly within the scope of the blow moulding procedure.

It is advantageous for (plastics) material to be removed from the aperture area or the transition area respectively during the production of the container.

BRIEF DESCRIPTION OF THE DRAWINGS

Further advantages and embodiments are evident from the accompanying drawings. In the drawings

FIG. 6 is a detailed view of the area B in a fourth embodiment of a container according to the invention, and FIG. 7 is a further view of the area B.

DETAILED DESCRIPTION OF THE INVENTION

Figure 1:
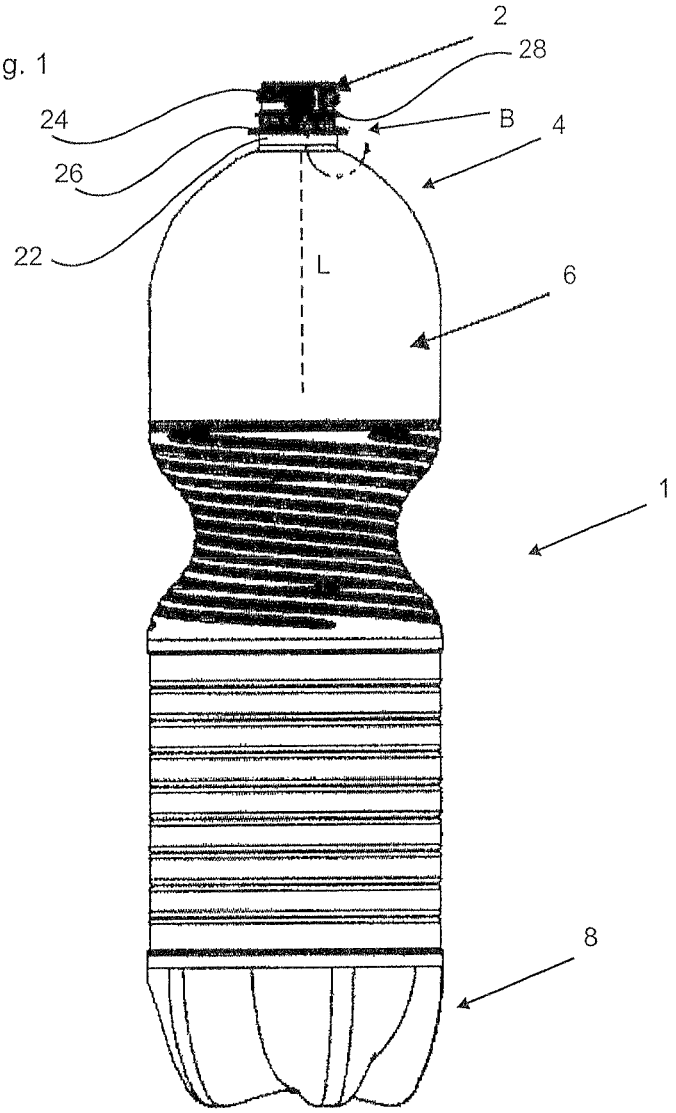
Fig. 1 Prior Art
FIG. 1 is a side view of a container according to the prior art.

FIG. 1 is a side view of a container 1 according to the prior art. This container 1 has an aperture area 2, by way of which liquid for example can be supplied to or removed from the container 1. An external thread 24 is provided on this aperture area 2. In addition, a carrier ring 26 and a locking ring 28 are also provided at this aperture area. A further variant (not shown) is to design the aperture area 2 without a carrier ring 26 but with a locking ring 28.

A cylindrical portion 22 is formed below the carrier ring 26. During an expansion procedure it is preferable for the area including the carrier ring 26 not to be stretched or expanded.

The aperture area 2 is adjoined by a shoulder area 4 of the container and this shoulder area in turn is adjoined by a main body 6 of the container 1. This main body 6 encloses in this case the greater part of the internal volume of the container 1. The reference number 8 refers to a base area which in turn adjoins the main body.

The reference letter B designates an area between the aperture area 2 and the shoulder area 4, to which the invention relates and which will be considered in greater detail below.

Figure 2:
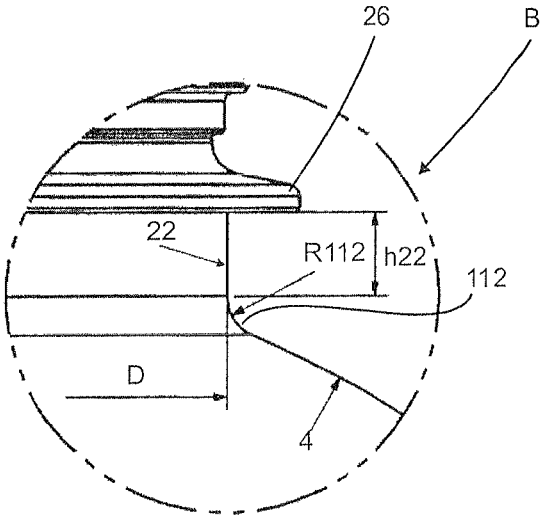
Fig. 2 Prior Art
FIG. 2 is a detailed view of the area B as shown in FIG. 1 according to the prior art.

FIG. 2 is an enlarged illustration of this area R. In this case, below the carrier ring 26, the cylindrical area 22 as well as a curved area 112 which forms the transition to the shoulder area 4 are again evident. This transition area 112 has in this case a pre-set area of curvature R112. The reference letter D refers to the diameter of the neck of the container, in which case the latter can be variable. The reference h 22 refers to a height or a length respectively in the longitudinal direction L. The transition area 112 is adjoined in turn by the shoulder area 4. In particular, the area 112 is particularly critical when the container or the inner wall thereof respectively is acted upon with a liquid. In this area 112 the film of liquid can tear off and, in this way, can no longer run on the inner wall but can arrive directly (in an undesired manner) in the base area.

Figure 3:
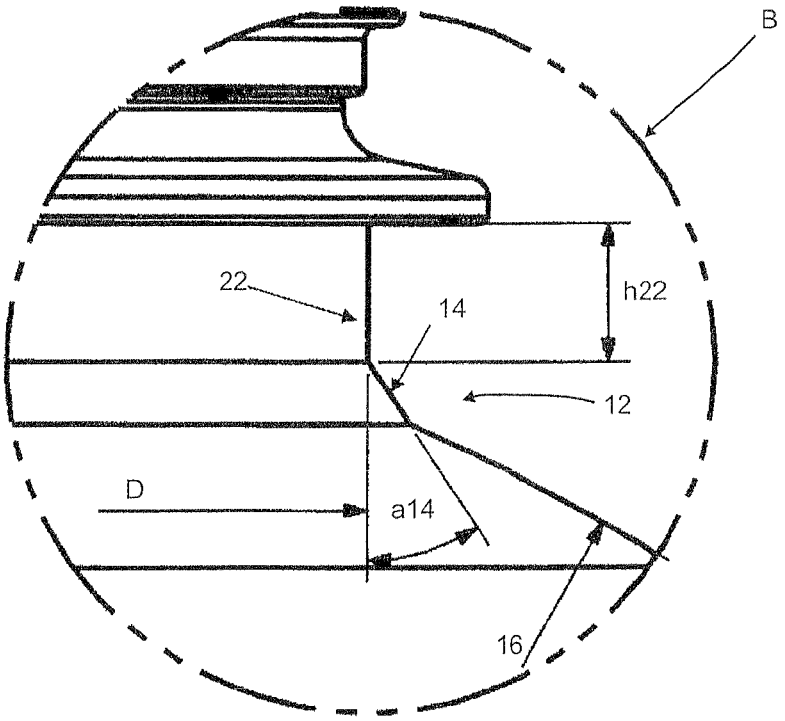
FIG. 3 is a detailed view of the area B for a container in a first embodiment according to the invention.

FIG. 3 shows the area B for a container according to the invention in a first embodiment. As mentioned above, an essential aspect of the invention lies in the fact that, in particular, this area B is modified. In this way, the filling, in particular, should be improved with a swirl body filling means. The radius R112 mentioned above is replaced by the variants shown in FIGS. 3 to 7. More precisely, the distribution of the plastics material is improved, in order also to save material in this area or to distribute it to another location of the bottle at which it improves other properties of the container.

In the case of the embodiment shown in FIG. 3 the curved area 112 shown in FIG. 2 is replaced by a portion 14 extending straight. This straight portion extends at an angle a14 with respect to the longitudinal direction or with respect to the cylindrical portion 22 extending vertically. The length of this cylindrical portion 22 can be selected as in the prior art or it can be set to a value which is between 0.01 mm and 8.0 mm and preferably between 3.0 mm and 5.0 mm. The aforesaid angle a14 is preferably selected, as mentioned above, in a range of between 2° and 65°. The length of the straight portion 14 can be between 0.01 mm and 50 mm, preferably between 0.5 mm and 10 mm, long, but does not adjoin the cylindrical portion 22 tangentially. It is preferable, however, for the portion 14 to be shorter than the height h22 of the cylindrical part 22. It is advantageous for the height h22 of the cylindrical part 22 to be at least double the size of the length of the straight portion 14.

In the case of the embodiment shown in FIG. 3 this straight portion 14 is adjoined by a second straight portion 16. Instead of a straight portion 16, a convex portion could also follow. In the case of the embodiment shown in FIG. 3 the second portion 16 does not adjoin the first portion 14 tangentially, but this would likewise be possible in the case of certain geometries. As shown in FIG. 1, the portion 16 is adjoined by the shoulder area 4 of the container. It would also be possible for the area 16 to be understood as a portion of the shoulder area.

The reference number 12 refers to the transition area between the aperture area 2 and the shoulder area 4, which in this case also contains the two portions 14, 16. It is preferable for this transition area to be formed between the cylindrical part 22 and the shoulder area.

Figure 4:
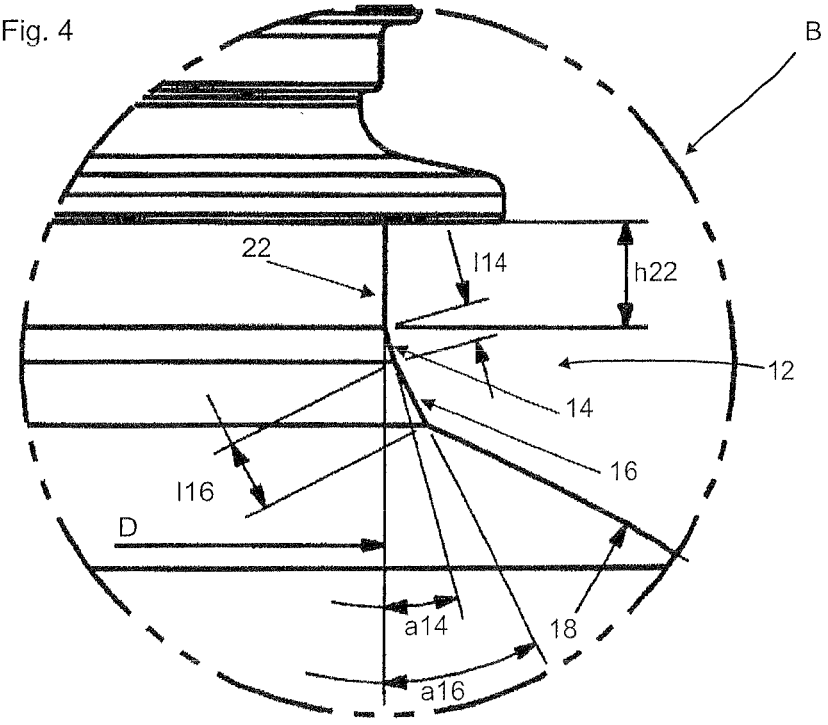
FIG. 4 is a detailed view of the area B in a second embodiment of a container according to the invention.

FIG. 4 shows a further embodiment of a container according to the invention. In the case of this embodiment the curved portion 112 is replaced by two straight portions 14 and 16 which are arranged at the angles a14 and a16 shown with respect to the longitudinal direction L. The diameter D of the neck of the container can be selected in this case as in the prior art. In addition, the height h22 of the cylindrical portion 22 can be selected as in the prior art or it can be set to a value which is between 0.01 mm and 8.0 mm and preferably between 3.0 mm and 5.0 mm. The length 114 of the first straight portion 14 can be selected for example between 0.01 mm and 50 mm, preferably between 0.5 mm and 10 mm, and in this case too it does not adjoin the cylindrical portion 22 tangentially. In addition, the length 116 of the second straight portion can be between 0.01 mm and 50 mm, preferably between 0.5 mm and 20 mm, and likewise does not adjoin the first straight portion 14 tangentially.

In this way, the angle a16 is preferably greater than the angle a14. It is advantageous for the length of the second straight portion 16 to be greater than the length of the first straight portion. It is also preferable for a difference between the angles a16 and a14 to be smaller than 60°, preferably smaller than 50°, preferably smaller than 40°, in a particularly preferred manner smaller than 30°, in a particularly preferred manner smaller than 20°, in a particularly preferred manner smaller than 10°, and in a particularly preferred manner smaller than 5°. The advantage of these relatively small angles is that they result in only slight bends at which a tearing of a film of liquid is highly improbable.

In this case the angles a relate in each case to the longitudinal direction L or to the portion 22 extending parallel to them. In this way, these angles preferably also represent the angles of the frustum formed by the portion 14.

The straight portion 16 can be adjoined by a further portion 18 which can both be straight and have a convex radius. If this third portion 18 is curved, a tangential attachment to the portion 16 would also be possible.

The angle a14 can also in this case be between 0.01° and 80°, preferably between 2° and 65°. The angle a16 is between 0.01° and 80°, preferably between 5° and 65°. In addition, in the case of the embodiment shown in FIG. 4 the portion 18 can again be adjoined by the container geometry known per se.

Figure 4A:
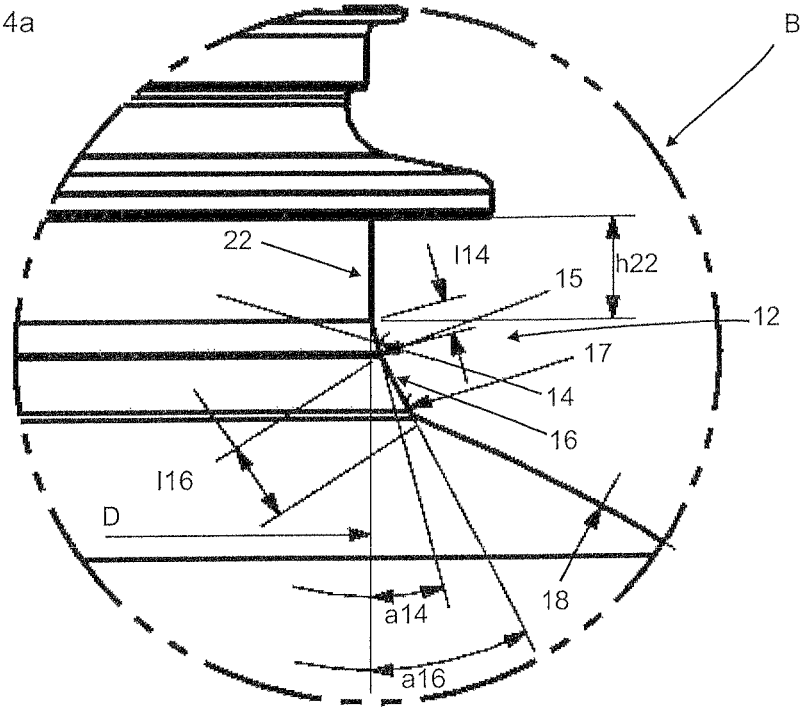
FIG. 4*a* shows a modification of the embodiment shown in FIG. 4.

FIG. 4*a* shows a modification of the embodiment shown in FIG. 4. Here two straight portions 14 and 16 are likewise provided, in which case a curved portion is situated between these straight portions 14, 16 and connects the two straight portions 14 and 16 to each other. In addition or as an alternative, a curved portion 17 can also be provided between the portions 14 and 16. It is advantageous for at least one of the two curved portions 15, 17 to be shorter than the respective straight portions 14 and 16. The radii of curvature of these curved portions are advantageously between 0.1 mm and 4.0 mm, and preferably between 0.5 mm and 3.0 mm The embodiment shown in FIG. 4*a*, i.e. in particular the provision of at least one curved area between the respective straight portions, has the effect that stress cracking or delamination of the material is inhibited or prevented in these areas.

Figure 5:
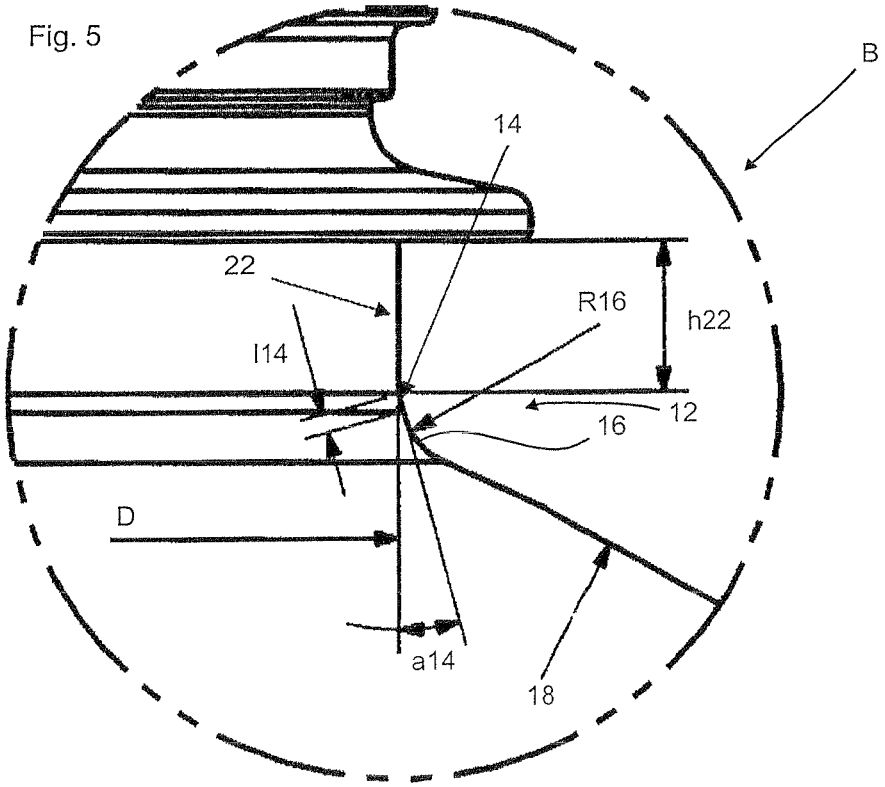
FIG. 5 is a detailed view of the area B in a third embodiment of a container according to the invention.

FIG. 5 shows a further embodiment of a container according to the invention. In the case of this arrangement too, the curved portion 112 shown in FIG. 1 is replaced by the straight portion 14, which extends at the angle a14 with respect to the longitudinal direction. In addition, the diameter D of the neck of the bottle corresponds to the diameters customary in the prior art. The height h22 of the cylindrical part is likewise selected as in the embodiment shown above. The length 114 of the straight portion 14 can again be between 0.01 mm and 50 mm, preferably between 0.5 mm and 10 mm, and it does not adjoin the cylindrical portion 22 tangentially. The first portion 14 is adjoined in this case by a curved portion 16, in which case this attachment is tangential here. The reference R16 designates a radius of curvature of this curved portion 16.

In this way, in the case of the embodiment illustrated in FIG. 5 too, the transition area, which is designated 12 as a whole and which contains the portions 14 and 16, is formed in at least two parts here. The attachment of the second portion 16 to the further portion 18 again takes place tangentially in this case. This means that the curvature of the second portion 16 in FIG. 5 increases downwards from the top. The portion 18 can again be made straight or also curved. The portion 18 is then adjoined again by the known container geometry.

FIG. 6 shows a further embodiment of a container according to the invention. In the case of this embodiment the curved portion 112 shown in FIG. 1 is replaced by two straight portions 14, 16 and a spline S16, which extend at the angles a14 and a16 with respect to the longitudinal direction. The diameter D is again selected here as in the case of the containers shown above and also the height h22 of the cylindrical portion remains the same.

In the same way as FIG. 6, FIG. 7 is an illustration of the geometries, in which case, however, the container itself has been omitted in FIG. 7 for the sake of improved visualization. The first portion 14 can again be of a length between 0.01 mm and 50 mm and again does not adjoin the cylindrical part 22 in a tangential or parallel manner. The point M1 designates the transition point between the cylindrical portion 22 and the first portion 14. The second portion 16 can be arranged both parallel and obliquely with respect to the first portion 14. The point M2 designates the transition point between the first portion 14 and the second portion 16.

The reference M3 designates a transition point between the second portion 16 and the spline S16. This transition from the portion 16 into the spline S16 can take place with a constant curvature in this case, but it is preferable for it to take place at a constant tangent in each case. The reference M4 designates a further transition point from the spline S16 into the area 18. This transition in the transition point M4 to the continuing container contour, which can comprise for example a concave or a convex radius or a straight line in the point M4, can have a constant curvature in this case, but it is preferable for it to take place at a constant tangent in each case, and it is preferably described by a polynomial of the nth degree.

Such a polynomial or a spline of the nth degree is a function which is formed piecemeal from polynomials with the maximum degree n. It is preferable in this case for n to be an integer which is larger than or equal to 2 and which is preferably smaller than or equal to 7. In this case preferred degrees of this function are, in particular, 2, 3, 5 or 7. The magnitude of the angle a14 in this case is again preferably between 0.01° and 80°, in particular between 2° and 65°. The magnitude of the angle a16 is preferably between 0.01° and 80°, and in a particularly preferred manner between 3° and 65°. The transition areas shown in FIGS. 6 and 7 can again adjoin the existing bottle geometries.

The reference number 12 refers to the transition area between the aperture area 2 and the shoulder area 4, which in this case also contains the two portions 14, 16 and the spline S16. It is preferable for this transition area to be formed between the cylindrical part 22 and the shoulder area.

The Applicants reserve the right to claim all the features disclosed in the application documents as being essential to the invention, insofar as they are novel either individually or in combination as compared with the prior art.

LIST OF REFERENCES

1 plastics material container
2 aperture area
4 shoulder area
6 main body
8 base area
12 transition area
14 portion extending straight
15 curved portion
16 portion adjoining the portion 14
17 curved portion
18 portion adjoining the portion 16
22 cylindrical portion
24 external thread
26 carrier ring
28 locking ring
112 portion (prior art)
R112 radius of the portion 112 (prior art)
L longitudinal direction of the plastics material container
a14 angle of the portion 14 with respect to the longitudinal direction of the container
114 length of the portion 14
a16 angle of the portion 16 with respect to the longitudinal direction of the container
116 length of the portion 16
h22 height of the cylindrical portion 22
M1-M4 transition points
B area
D diameter
R16 radius of curvature of the area 16
S16 spline or polynomial of the nth degree of the area 16

The invention claimed is:

1. A plastics material container for filling goods susceptible to foaming during filling an aperture area, a shoulder area adjoining the aperture area in a longitudinal direction of the plastics material container, a main body adjoining this shoulder area in the longitudinal direction of the plastics material container and a base area adjoining the main body in the longitudinal direction of the plastics material container, wherein the shoulder area is widened in the longitudinal direction of the plastics material container from the aperture area in the direction of the main body, and wherein a transition area is provided between the aperture area and the shoulder area, wherein the transition area has a curved portion closer to the aperture area widening in the longitudinal direction of the plastics material container from the aperture in the direction of the shoulder area and having a straight course, and wherein during filling with goods, material will attach to and flow over an inner wall of the transition area without directly impacting on a base of the container, whereupon foaming is prevented.

2. The plastics material container according to claim 1, wherein the portion widening extends, with respect to the longitudinal direction, at an angle which is between 0.01° and 80°.

3. The plastics material container according to claim 1, wherein the portion widening is of a length which is between 0.01 mm and 50 mm.

4. The plastics material container according to claim 1, wherein the container has a cylindrical portion, and the straight course directly adjoins the cylindrical portion.

5. The plastics material container according to claim 1, wherein the shoulder area widens starting from the transition area.

6. The plastics material container according to claim 1, wherein the portion widening with the straight course is adjoined by a further portion with a straight course.

7. The plastics material container according to claim 1, wherein the transition area also has, in addition to the portion with the straight course, a portion with a curved course.

8. The plastics material container according to claim 1, wherein the transition area has, in addition to the portion with the straight course, a further portion with a straight course.

9. A method of filling a plastics material container with carbonated filling goods, comprising the steps:

making available a plastics material container having an aperture area, a shoulder area adjoining the aperture area in a longitudinal direction of the plastics material container, a main body adjoining this shoulder area in the longitudinal direction of the plastics material container and a base area adjoining the main body in the longitudinal direction of the plastics material container, wherein the shoulder area is widened in the longitudinal direction of the plastics material container from the aperture area in the direction of the main body, and wherein a transition area is provided between the aperture area and the shoulder area, wherein the transition area has a curved portion closer to the aperture widening area widening in the longitudinal direction of the plastics material container from the aperture in the direction of the shoulder area and having a straight course, and filling the container with a liquid, wherein the liquid poured into the plastics material container is applied at least in part to a portion, at a distance from the base area of the plastic material container, of an inner wall of the plastics material container, wherein during filling, material will flow over the inner wall of the container without directly impacting on a base of the container, whereupon excessive foaming is prevented.

10. A method according to claim 9, wherein the liquid poured into the plastics material container is applied at least in part to a portion of the inner wall of the aperture area of the plastics material container.

11. A method according to claim 9, wherein the liquid is applied to the inner wall of the container in a direction which also has a component in the peripheral direction of the container.

12. The plastics material container according to claim 1, wherein the portion widening extends, with respect to the longitudinal direction, at an angle which is between 2° and 65°.

13. The plastics material container according to claim 1, wherein the portion widening extends, with respect to the longitudinal direction, at an angle which is between 1° and 75°.

14. The plastics material container according to claim 1, wherein the portion widening extends, with respect to the longitudinal direction, at an angle which is between 2° and 65°.

15. The plastics material container according to claim 1, wherein the portion widening is of a length which is between 0.1 mm and 40 mm.

16. The plastics material container according to claim 1, wherein the portion widening is of a length which is between 1 mm and 20 mm.

17. The plastics material container according to claim 1, wherein the portion widening adjoins the straight portion at an angle deviating from a tangential direction.

18. A plastics material container with an aperture area, a shoulder area adjoining the aperture area in a longitudinal direction of the plastics material container, a main body adjoining this shoulder area in the longitudinal direction of the plastics material container and a base area adjoining the main body in the longitudinal direction of the plastics material container, wherein the shoulder area is widened in the longitudinal direction of the plastics material container from the aperture area in the direction of the main body, and wherein a transition area is provided between the aperture area and the shoulder area, wherein the transition area has a curved portion closer to the aperture area widening in the longitudinal direction of the plastics material container from the aperture in the direction of the shoulder area and having a straight course, wherein the portion widening is adjoined by a further portion with a straight course that is greater in length than a length of the straight portion and wherein the container is a container designed and shaped for carbonated filling goods, wherein during filling, material will flow over an inner wall of the container without directly impacting on a base of the container, whereupon excessive foaming is prevented.

19. The plastics material container according to claim 1, wherein the portion widening extends, with respect to the longitudinal direction, at an angle which is between 2° to 40°.

20. A plastics material container for filling goods susceptible to foaming during filling, said container having an aperture area, a shoulder area adjoining the aperture area in a longitudinal direction of the plastics material container, a main body adjoining this shoulder area in the longitudinal direction of the plastics material container and a base area adjoining the main body in the longitudinal direction of the plastics material container, wherein the shoulder area is widened in the longitudinal direction of the plastics material container from the aperture area in the direction of the main body, and wherein a transition area is provided between the aperture area and the shoulder area, wherein the transition area has a curved portion closer to the aperture area widening in the longitudinal direction of the plastics material container from the aperture in the direction of the shoulder area and having a straight course, wherein the widening portion extends, with respect to the longitudinal direction, at an angle which is between 2° and 40°, wherein during filling with goods, material will attach to and flow over an inner wall of the transition area without directly impacting in a base of the container, whereupon foaming is prevented.

21. The plastics material container according to claim 20, wherein the portion widening adjoins the straight portion at an angle deviating from a tangential direction.

22. A plastics material container with an aperture area, a shoulder area adjoining the aperture area in a longitudinal direction of the plastics material container, a main body adjoining this shoulder area in the longitudinal direction of the plastics material container and a base area adjoining the main body in the longitudinal direction of the plastics material container, wherein the shoulder area is widened in the longitudinal direction of the plastics material container from the aperture area in the direction of the main body, and wherein a transition area is provided between the aperture area and the shoulder area, wherein the transition area has a curved portion closer to the aperture area widening in the longitudinal direction of the plastics material container from the aperture in the direction of the shoulder area and having a straight course, wherein the widening portion extends, with respect to the longitudinal direction, at an angle which is between 2° and 40°, and wherein the portion widening is adjoined by a further portion with a straight course that is greater in length than a length of the straight portion.

* * * * *